United States Patent [19]

Hirano et al.

[11] Patent Number: 4,669,426

[45] Date of Patent: Jun. 2, 1987

[54] COOLING SYSTEM FOR AUTOMOTIVE ENGINE OR THE LIKE

[75] Inventors: Yoshinori Hirano, Yokohama; Takao Kubozuka, Yokosuka; Yoji Ito, Tokyo, all of Japan

[73] Assignee: Nissan Motor Co., Ltd., Yokohama, Japan

[21] Appl. No.: 823,746

[22] Filed: Jan. 29, 1986

[51] Int. Cl.[4] ..... F01P 3/22; F01P 11/18

[52] U.S. Cl. ..... 123/41.15; 123/41.21; 123/41.27; 123/198 DB

[58] Field of Search ..... 123/41.15, 41.21, 41.27, 123/198 DB, 198 DC

[56] References Cited

U.S. PATENT DOCUMENTS 4,454,843 6/1984 Uchida et al. ..... 123/198 DB 4,487,180 12/1984 Ito et al. ..... 123/41.15

4,548,183 10/1985 Hayashi ..... 123/41.15

4,554,891 11/1985 Hayashi ..... 123/41.15

4,556,029 12/1985 Yamaguchi et al. ..... 123/41.15

*Primary Examiner*—William A. Cuchlinski, Jr.

*Attorney, Agent, or Firm*—Schwartz, Jeffery, Schwaab, Mack, Blumenthal & Evans

[57] ABSTRACT

In order to diagnose a malfunction an evaporative cooling system upon the engine being initially started or in response to a demand for engine operation (e.g. cranking of the engine) the outputs of a sensor or sensors are monitored and diagnostic check of the system performed to determine if the sensors and or valves of the system are operating properly. In the event that a malfunction is indicated a warning is issued and/or the operation of the engine prevented.

12 Claims, 21 Drawing Figures

COOLING SYSTEM FOR AUTOMOTIVE ENGINE OR THE LIKE

BACKGROUND OF THE INVENTION

1. Field of the Invention

The present invention relates generally to an evaporative type cooling system for an internal combustion engine wherein liquid coolant is permitted to boil and the vapor used as a vehicle for removing heat therefrom, and more specifically to such a system which is able to diagnose system malfuctions at the time of engine start-up.

2. Description of the Prior Art

In currently used 'water cooled' internal combustion engines such as shown in FIG. 1 of the drawings. the engine coolant (liquid) is forcefully circulated by a water pump, through a cooling circuit including the engine coolant jacket and an air cooled radiator. This type of system encounters the drawback that a large volume of water is required to be circulated between the radiator and the coolant jacket in order to remove the required amount of heat. Further, due to the large mass of water inherently required, the warm-up characteristics of the engine are undesirably sluggish. For example, if the temperature difference between the inlet and discharge ports of the coolant jacket is 4 degrees, the amount of heat which 1 Kg of water may effectively remove from the engine under such conditions is 4 Kcal. Accordingly, in the case of an engine having an 1800 cc displacement (by way of example) is operated full throttle, the cooling system is required to remove approximately 4000 Kcal/h. In order to achieve this, a flow rate of approximately 167 liter/min must be produce by the water pump. This of course undesirably consumes a number of otherwise useful horsepower.

Further. the large amount of coolant utilized in this type of system renders the possiblity of quickly changing the temperature of the coolant in a manner that instant coolant temperature can be matched with the instant set of engine operational conditions such as load and engine speed, completely out of the question.

FIG. 2 shows an arrangement disclosed in Japanese Patent Application Second Provisional Publication Sho. No. 57-57608. This arrangement has attempted to vaporize a liquid coolant and use the gaseous form thereof as a vehicle for removing heat from the engine. In this system the radiator 1 and the coolant jacket 2 are in constant and free communication via conduits 3, 4 whereby the coolant which condenses in the radiator 1 is returned to the coolant jacket 2 little by little under the influence of gravity.

This arrangement while eliminating the power consuming coolant circulation pump which plagues the above mentioned arrangement, has suffered from the drawbacks that the radiator, depending on its position with respect to the engine proper, tends to be at least partially filled with liquid coolant. This greatly reduces the surface area via which the gaseous coolant (for example steam) can effectively release its latent heat of vaporization and accordingly condense, and thus has lacked any notable improvement in cooling efficiency.

Further, with this system in order to maintain the pressure within the coolant jacket and radiator at atmospheric level, a gas permeable water shedding filter 5 is arranged as shown, to permit the entry of air into and out of the system. However, this filter permits gaseous coolant to readily escape from the system, inducing the need for frequent topping up of the coolant level.

A further problem with this arrangement has come in that some of the air, which is sucked into the cooling system as the engine cools, tends to dissolve in the water, whereby upon start up of the engine, the dissolved air tends to come out of solution and form small bubbles in the radiator which adhere to the walls thereof and form an insulating layer. The undissolved air also tends to collect in the upper section of the radiator and inhibit the convection-like circulation of the vapor from the cylinder block to the radiator. This of course further deteriorates the performance of the device.

Moreover, with the above disclosed arrangement the possibility of varying the coolant temperature with load is prevented by the maintainance of the internal pressure of the system constantly at atmospheric level.

European Patent Application Provisional Publication No. 0 059 423 published on Sept. 8, 1982 discloses another arrangement wherein, liquid coolant in the coolant jacket of the engine, is not forcefully circulated therein and permitted to absorb heat to the point of boiling. The gaseous coolant thus generated is adiabatically compressed in a compressor so as to raise the temperature and pressure thereof and thereafter introduced into a heat exchanger (radiator). After condensing, the coolant is temporarily stored in a reservoir and recycled back into the coolant jacket via a flow control valve.

This arrangement has suffered from the drawback that when the engine is stopped and cools down the coolant vapor condenses and induces sub-atmospheric conditions which tend to induce air to leak into the system This air tends to be forced by the compressor along with the gaseous coolant into the radiator. Due to the difference in specific gravity, the air tends to rise in the hot environment while the coolant which has condensed moves downwardly. The air, due to this inherent tendency to rise, forms pockets of air which cause a kind of 'embolism' in the radiator and which badly impair the heat exchange ability thereof. With this arrangement the provision of the compressor renders the control of the pressure prevailing in the cooling circuit for the purpose of varying the coolant boiling point with load and/or engine speed difficult.

U.S. Pat. No. 4,367,699 issued on Jan. 11, 1983 in the name of Evans (see FIG. 3 of the drawings) discloses an engine system wherein the coolant is boiled and the vapor used to remove heat from the engine. This arrangement features a separation tank 6 wherein gaseous and liquid coolant are initially separated. The liquid coolant is fed back to the cylinder block 7 under the influence of gravity while the relatively dry gaseous coolant (steam for example) is condensed in a fan cooled radiator 8.

The temperature of the radiator is controlled by selective energizations of the fan 9 which maintains a rate of condensation therein sufficient to provide a liquid seal at the bottom of the device. Condensate discharged from the radiator via the above mentioned liquid seal is collected in a small reservoir-like arrangement 10 and pumped back up to the separation tank Via a small constantly energized pump 11.

This arrangement, while providing an arrangement via which air can be initially purged to some degree from the system tends to, due to the nature of the arrangement which permits said initial non-condensible matter to be forced out of the system, suffers from rapid loss of coolant when operated at relatively high altitudes. Further, once the engine cools air is relatively freely admitted back into the system. The provision of the bulky separation tank 6 also renders engine layout difficult.

Further, the rate of condensation in the consensor is controlled by a temperature sensor disposed on or in the condensor per se in a manner which holds the pressure and temperature within the system essentially constant. Accordingly, temperature variation with load is rendered impossible.

Japanese Patent Application First Provisional Publication No. sho. 56-32026 (see FIG. 4 of the drawings) discloses an arrangement wherein the structure defining the cylinder head and cylinder liners are covered in a porous layer of ceramic material 12 and wherein coolant is sprayed into the cylinder block from shower-like arrangements 13 located above the cylinder heads 14. The interior of the coolant jacket defined within the engine proper is essentially filled with gaseous coolant during engine operation at which time liquid coolant sprayed onto the ceramic layers 12.

However, this arrangement has proven totally unsatisfactory in that upon boiling of the liquid coolant absorbed into the ceramic layers, the vapor thus produced and which escapes into the coolant jacket. inhibits the penetration of fresh liquid coolant and induces the situation wherein rapid overheat and thermal damage of the ceramic layers 12 and/or engine soon results. Further, this arrangement is of the closed circuit type and is plagued with air contamination and blockages in the radiator similar to the compressor equipped arrangement discussed above.

FIG. 7 shows an arrangement which is disclosed in U.S. Pat. No. 4,549,505 filed on Oct. 29, 1985 in the name of Hirano. The disclosure of this application is hereby incorporated by reference thereto.

For convenience the same numerals as used in the above mentioned Patent are also used in FIG. 7.

This arrangement while overcomming the drawbacks encountered with the prior art has encountered the problem that a malfunction of the sensors or valves used therein can lead to serious engine damage if not detected very quickly.

For example. if one of the level sensors (130, 140) should become inoperative it is very likely that the correct amount of coolant will not be retained in the coolant jacket 120. For example, if the coolant jacket level sensor 140 malfunctions it is possible that the coolant return pump 136 will be operated excessively to overfill the coolant jacket 120. While this tends to prevent localized dryouts and hot spot formation the tendancy for liquid coolant to flow over into the radiator 126 can reduce the heat exchange efficiency of the device to the point that the vapor pressure in the system rapidly exceeds permissible limits and engine overheat condition is induced. On the other hand, if insufficient coolant is pumped into the coolant jacket 120 due to level sensor malfuction, the possiblity of localized dryouts and hot spot formation exists with the likelyhood of rapid engine damage such as engine seizure.

In the event that the purge conduit control valve 170 fails and does not open in response to an energization signal from the control circuit during the 'non-condensible matter purge' operation when excess coolant from reservoir 146 is pumped into the cooling circuit in a manner to overfill the same and flush any traces of air or the like non-condensible contaminating matter out of the system prior operative temperatures being reached; the system is apt to be hydraulically overpressurized inviting a rupture of the conduiting or like components of the arrangement. In order to detect the just mentioned overpressurization, it is possible to provide a pressure sensor which is responsive to the pressure differential between the interior of the cooling system and the ambient atmosphere. However, in the event that this device is not operating properly the just mentioned overpressurization is apt to occur and/or if the system should be subject to an overcooling (due to prolonged down hill coasting, extremely cold climate or the like) sub-atmospheric conditions which can crush the conduiting of the radiator or the like is apt to go undetected and before suitable steps taken, and severe damage of the system take place.

SUMMARY OF THE INVENTION

It is an object of the present invention to provide an evaporative cooling system which can diagnose system malfuction and prevent engine damage.

In brief, the above objects are achieved by an arrangement wherein in order to diagnose a malfuction an evaporative cooling system, upon the engine being initially started or in response to a demand for engine operation (e.g. cranking of the engine) the outputs of a sensor or sensors are monitored and diagnostic check of the system performed to determine if the sensors and or valves of the system are operating properly. In the event that a malfuction is indicated a warning is issued and/or the operation of the engine prevented.

More specifically, a first aspect of the present invention takes the form of an internal combustion engine having a structure subject to high heat flux which features a cooling system comprising: (a) a cooling circuit which includes: (i) a coolant jacket disposed about the structure, the coolant jacket being arranged to receive coolant in liquid form and discharge the same in gaseous form; (ii) a radiator in fluid communication with the coolant jacket for receiving the coolant vapor produced in the coolant jacket and condensing same to a condensate: and (iii) means for returning the condensate formed in the radiator to the coolant jacket in a manner which maintains the structure immersed in predetermined depth of liquid coolant; (b) a sensor responsive to a parameter which varies with the amount of coolant in the cooling circuit; and (c) a control circuit including means for monitoring the output of the sensor and for within a predetermined period of one of (a) a demand for engine operation; and (b) the initiation of engine operation, diagnosing a malfuntion in the cooling system and issuing a signal indicative thereof.

A second aspect of the invention come in a method of operating a cooling system of an internal combustion engine comprising the steps of: introducing liquid coolant into a coolant jacket disposed about a structure of the engine which is subject to high heat flux; permitting the liquid coolant to boil and produced vapor; condensing the vapor into a condensate in a radiator; returning the condensate formed in the radiator to the coolant jacket in a manner which maintains the structure immersed in a predetermined depth of coolant; sensing a parameter which varies with the amount of coolant contained in a cooling circuit which includes the coolant jacket and the radiator and producing a signal indicative thereof; monitoring the signal and determining within a predetermined period from one of (a) the start of the engine and (b) the demand for engine operation;

diagnosing the existence of a system malfuction based on the data derived in the step of monitoring, and one of producing a signal indicative thereof and stopping the operation of the engine.

BRIEF DESCRIPTION OF THE DRAWINGS

The features and advantages of the arrangement of the present invention will become more clearly appreciated from the following description taken in conjunction with the accompanying drawings in which.

DETAILED DESCRIPTION OF THE PREFERRED EMBODIMENTS

Before proceeding with the description of the embodiments of the present invention, it is deemed appropriate to discuss some of the basic features of the type of cooling system to which the present invention is directed.

Figure 1:
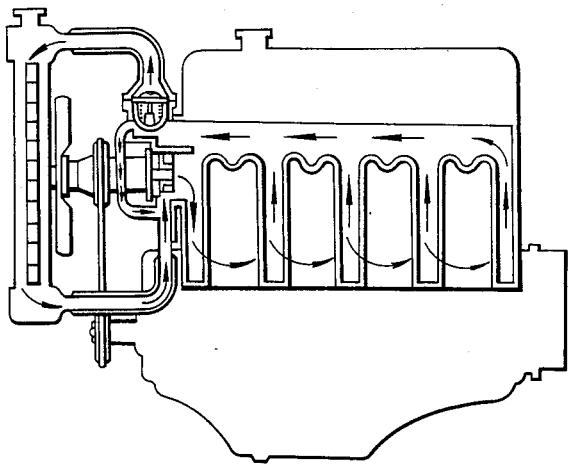
FIG.1 (PRIOR ART)
FIGS. 1 to 4 show the prior art arrangements discussed in the opening paragraphs of the instant disclosure.
Figure 2:
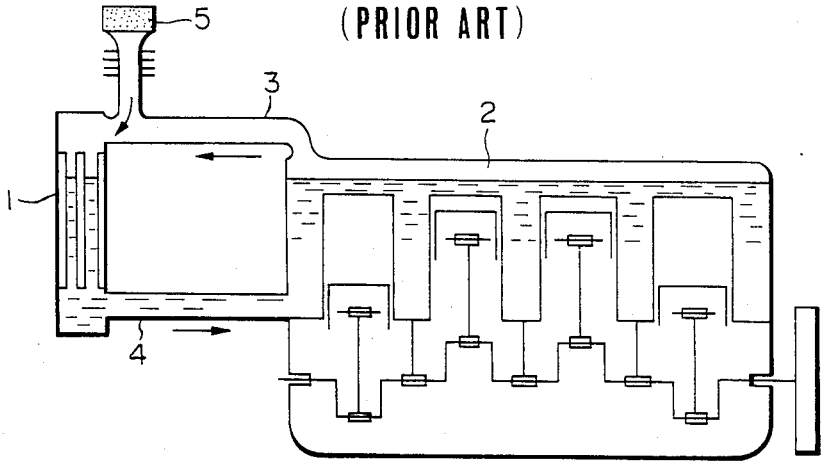
FIG.2 (PRIOR ART)
Figure 3:
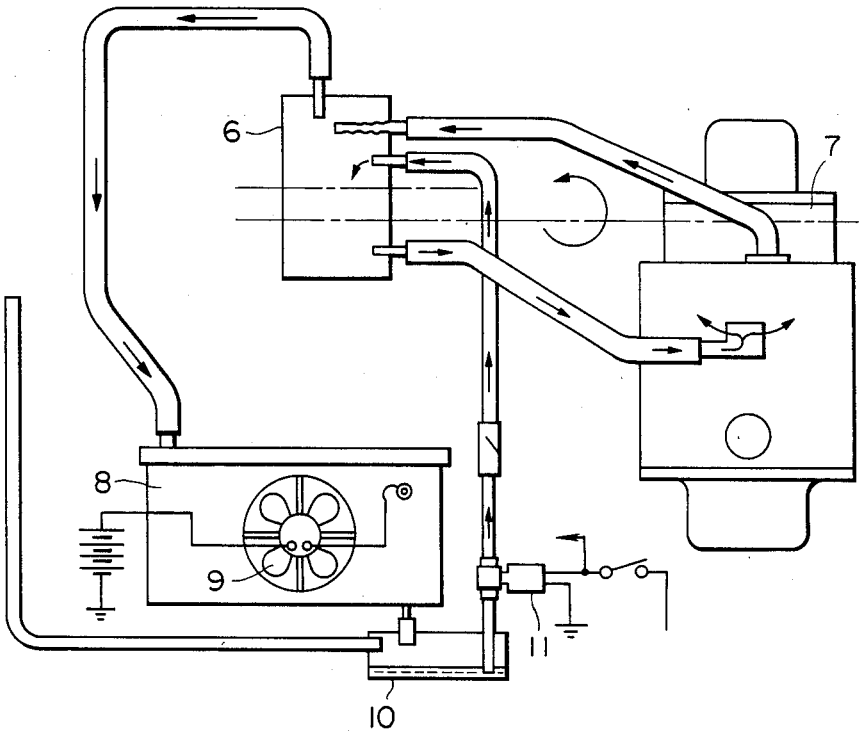
FIG. 3 (PRIOR ART)
Figure 4:
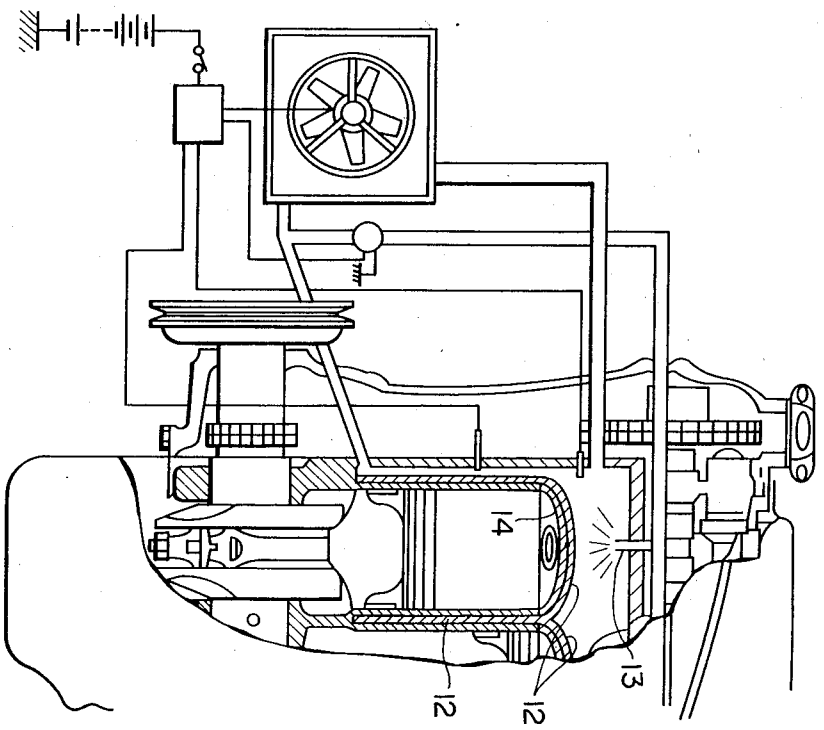
FIG.4 (PRIOR ART)
Figure 5:
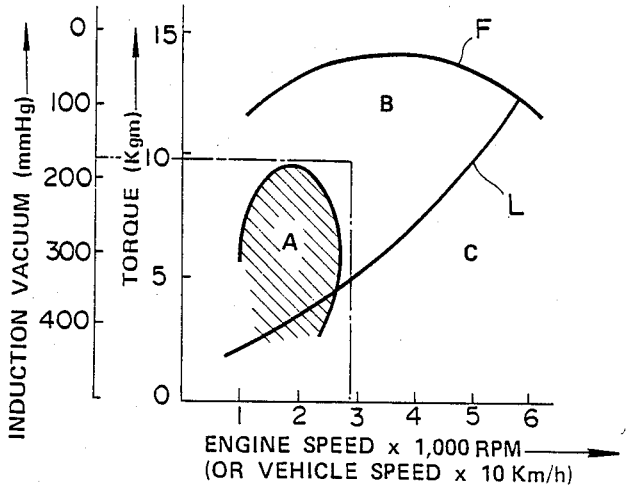
FIG. 5 is a diagram showing in terms of engine load and engine speed the various load zones which are encountered by an automotive internal combustion engine.
Figure 6:
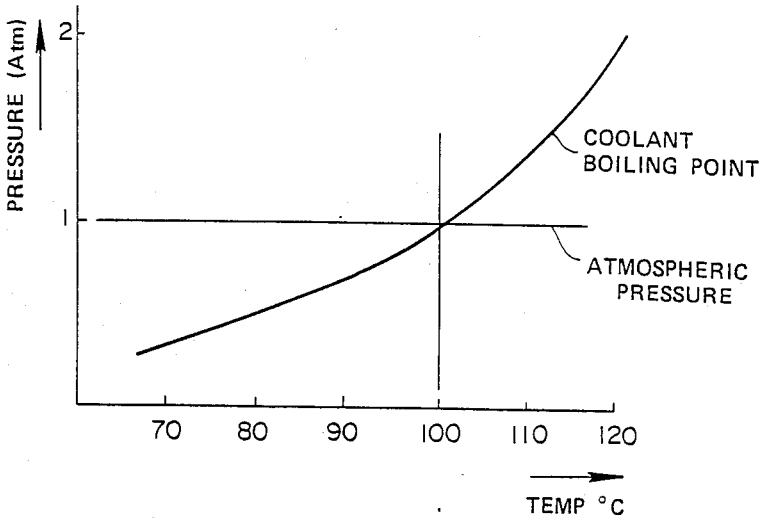
FIG. 6 is a graph showing in terms of pressure and temperature the changes in the coolant boiling point in a closed circuit type evaporative cooling system.
Figure 7:
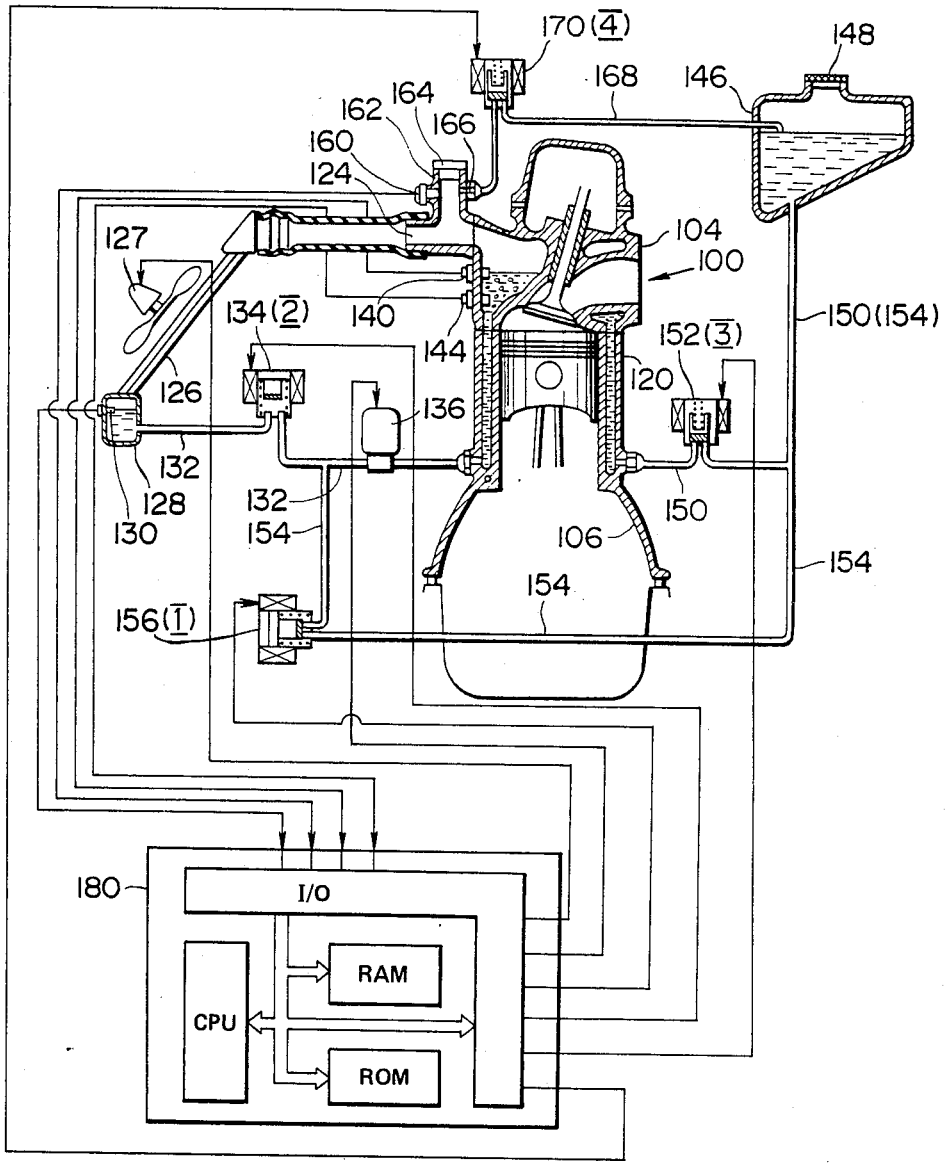
FIG. 7 shows in schematic elevation the arrangement disclosed in the opening paragraphs of the instant disclosure in conjunction with U.S. Pat. No. 4,549,505.

FIG. 5 graphically shows in terms of engine torque and engine speed the various load 'zones' which are encountered by an automotive vehicle engine. In this graph, the curve F denotes full throttle torque characteristics, trace R/L denotes the resistance encountered when a vehicle is running on a level surface, and zones A, B and C denote respectively low load/low engine speed operation such as encountered during what shall be referred to 'urban cruising'; low speed high/load engine operation such as hillclimbing, towing etc., and high engine speed operation such as encountered during high speed cruising.

A suitable coolant temperature for zone A is approximately 100°–110° C.; for zone B 80°–90 ° C. and for zone C 90°–100° C. The high temperature during 'urban cruising' promotes improved thermal efficiency. On the other hand, the lower temperatures of zones B and C are such as to ensure that sufficient heat is removed from the engine and associated structure to prevent engine knocking and/or thermal damage.

With the present invention, in order to control the temperature of the engine, advantage is taken of the fact that with a cooling system wherein the coolant is boiled and the vapor used as a heat transfer medium, the amount of coolant actually circulated between the coolant jacket and the radiator is very small, the amount of heat removed from the engine per unit volume of coolant is very high, and upon boiling, the pressure prevailing within the coolant jacket and consequently the boiling point of the coolant rises if the system employed is of the closed circuit type. Thus, during 'urban cruising' by circulating only a limited amount of cooling air over the radiator, it is possible reduce the rate of condensation therein and cause the pressure within the cooling system to rise above atmospheric and thus induce the situation, wherein the engine coolant boils at temperatures above 100° C. for example at approximately 110° C.

In addition to the control afforded by the air circulation the present invention is arranged to positively pump coolant into the system so as to vary the amount of coolant actually in the cooling circuit in a manner which modifies the pressure prevailing therein. The combination of the two controls enables the temperature at which the coolant boils to be quickly brought to and held close to that deemed most appropriate for the instant set of operation conditions.

On the other hand, during high speed cruising for example, when a lower coolant boiling point is highly beneficial, it is further possible by increasing the flow cooling air passing over the radiator, to increase the rate of condensation within the radiator to a level which reduces the pressure prevailing in the cooling system below atmospheric and thus induce the situation wherein the coolant boils at temperatures in the order of 80° to 100° C. In addition to this, the present invention also provides for coolant to be displaced out of the cooling circuit in a manner which lowers the pressure in the system and supplements the control provide by the fan in a manner which permits the temperature at which the coolant boils to be quickly brought to and held at a level most appropriate for the new set of operating conditions.

However, if the pressure in the system drops to an excessively low level the tendancy for air to find its way into the interior of the cooling circuit becomes excessively high and it is desirable under these circumstances to limit the degree to which a negative pressure is permitted to develop. The present invention controls this by introducing coolant into the cooling circuit while it remains in an essentially hermetically sealed state and raises the pressure in the system to a suitable level.

Each of the zones of control be discussed in detail. It should be noted that the figures quoted in this discussion relate to a reciprocating type internal engine having a 1800 cc displacement.

ZONE A

In this zone (low speed/low torque) as the torque requirments are not high, emphasis is placed on good fuel economy. Accordingly, the lower limit of the temperature range of 100° to 110° C. is selected on the basis that, above 100° C. the fuel consumption curves of the engine tend to flatten out and become essentially constant. On the other hand, the upper limit of this range is selected in view of the fact that if the temperature of the coolant rises to above 110° C., as the vehicle is inevitably not moving at any particular speed during this mode of operation there is very little natural air circulation within the engine compartment and the temperature of the engine room tends to become sufficiently high as to have an adverse effect on various temperature sensitive elements such as cog belts of the valve timing gear train, elastomeric fuel hoses and the like. Accordingly, as no particular improvement in fuel consumption characteristics are obtained by controlling the coolant temperature to levels in excess of 110° C., the upper limit of zone A is held thereat.

It has been found that the torque generation characteristics tend to drop off slightly with temperatures above 100° C., accordingly, in order to minimize the loss of torque it is deemed advantageous to set the upper torque limit of zone A in the range of 7 to 10 kgm.

The upper engine speed of this zone is determined in view of that fact that above engine speeds of 2,400 to 3600 RPM a slight increase in fuel consumption characteristics can be detected. Hence, as it is fuel economy rather than maximum torque production characteristics which are sought in this zone, the boundry between the low and high engine speed ranges is drawn within the just mentioned engine speed range. It will be of course appreciated as there are a variety of different types of engines on the market viz., diesel engines (e.g. trucks industrial vehicles), high performance engines (e.g. sports cars), low stressed engines for economical urban use vehicles, etc., the above mentioned ranges cannot be specified with any particular type in mind but do hold generally true for all types.

ZONE B

In this zone (high torque/low engine speed) torque is of importance. In order to avoid engine knocking, improve engine charging efficiency, reduce residual gas in the engine combustion chambers and maximize torque generation, the temperature range for this zone is selected to span from 80° to 90° C. With this a notable improvement in torque characteristics is possible. Further, by selecting the upper engine speed for this zone to fall in the range of 2,400 to 3600 RPM it is possible to improve torque generation as compared with the case wherein the coolant temperature is held at 100° C., while simultaneously improving the fuel consumption characteristics.

The lower temperature of this zone is selected in view of the fact that if anti-freeze is mixed with the coolant, at a temperature of 80° C. the pressure prevailing in the interior of the cooling system lowers to approximately 630 mmHg. At this pressure the tendancy for atmospheric air to leak in past the gaskets and seals of the engine becomes particularly high. Hence, in order to avoid the need for expensive parts in order to maintain the relatively high negative pressure (viz., prevent crushing of the radiator and interconnecting conduiting) and simultaneously prevent the invasion of air, the above mentioned lower limit is selected.

ZONE C

In this zone (high speed) as the respiration characteristics of the engine inherently improve, it is not neccesary to maintain the coolant temperature as low as in zone B for this purpose. However, as the amount of heat generated per unit time is higher than during the lower speed modes the coolant tends to boil much more vigorously. As a result an increased amount of liquid coolant tends to bump and froth up out of the coolant jacket and find its way into the radiator.

Until the volume of liquid coolant which enters the radiator reaches approximately 3 liters/min. there is little or no adverse effect on the amount of heat which can be released from the radiator. However, in excess of this figure, a marked loss of heat exchange efficiency may be observed. Experiments have shown that by controlling the boiling point of the coolant in the region of 90° C. under high speed cruising the amount of liquid coolant can be kept below the critical level and thus the system undergoes no particular adverse loss of heat release characteristics at a time when the maximization of same is vital to prevent engine overheat.

It has been further observed that if the coolant temperature is permitted to rise above 100° C. then the temperature of the engine lubricant tends to rise above 130° C. and undergo unnecessarily rapid degredation. This tendancy is particular notable if the ambient temperature is above 35° C. As will be appreciated if the engine oil begins to degrade under high temperature, heat sensitive bearing metals and the like of the engine also undergo damage.

Hence, from the point of engine protection the coolant is controlled within the range of 90°–100° C. once the engine speed has exceeded the value Which divides the high and low engine speed ranges.

ENGINE SYSTEM

Figure 8:
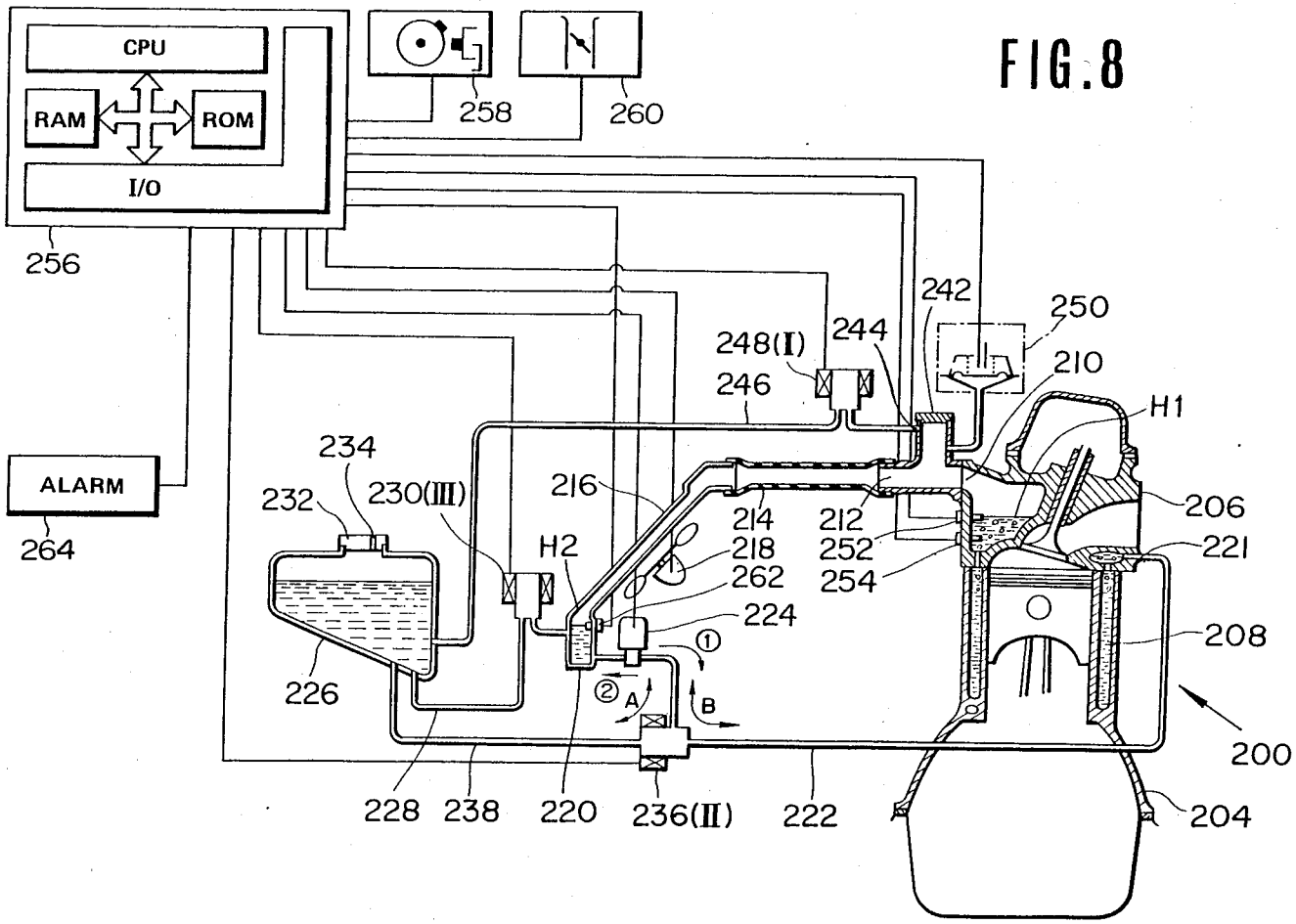
FIG. 8 shows an engine cooling system incorporating embodiments of the present invention.

FIG. 8 of the drawings shows an engine system to which the embodiments of the invention are applied. In this arrangement an internal combution engine 200 includes a cylinder block 204 on which a cylinder head 206 is detachably secured. The cylinder head and block are formed with suitably cavities which define a coolant jacket 208 about structure of the engine subject to high heat flux (e.g. combustion chambers exhaust valves conduits etc.,). Fluidly communicating with a vapor discharge port 210 formed in the cylinder head 206 via a vapor manifold 212 and vapor conduit 214, is a condensor 216 or radiator as it will be referred to hereinafter. Located adjacent the radiator 216 is a selectively energizable electrically driven fan 218 which is arranged to induce a cooling draft of air to pass over the heat exchanging surface of the radiator 216 upon being put into operation.

A small collection reservoir 220 or lower tank as it will be referred to hereinlater is provided at the bottom of the radiator 216 and arranged to collect the condensate produced therein. Leading from the lower tank 220 to a coolant inlet port 221 formed in the cylinder head 206 is a coolant return conduit 222. A small capacity electrically driven pump 224 is disposed in this conduit at a location relatively close to the radiator 216. According to the present invention, this pump 224 is arranged to reversible—that is energizable so as to induct coolant from the lower tank 220 and pump same toward the coolant jacket 208 (viz., pump coolant in a first flow direction) and energizable so as to pump coolant in the reverse direction (second flow direction)—i.e. induct coolant through the return conduit 222 and pump it into the lower tank 220. The reason for this particular arrangement will become clear hereinlater.

A coolant reservoir 226 is arranged to communicate with the lower tank 220 via a supply conduit 228 in which an electromagnetic flow control valve 230 is disposed. This valve is arranged to closed when energized. The reservoir 226 is closed by a cap 232 in which an air bleed 254 is formed. This permits the interior of the reservoir 226 to be maintained constantly at amospheric pressure.

A three-way valve 236 is disposed in the coolant return conduit 222 and arranged to communicate with the reservoir 226 via a level control conduit 238. This valve is arranged to have a first state wherein fluid communication is established between the pump 224 and the reservoir 226 (viz., flow path A) and a second state wherein communication between the pump 224 and the coolant jacket 208 is established (viz., flow path B).

The vapor manifold 212 is formed with a riser portion 240. This riser portion 240 as shown, is provided with a cap 242 which hermetically closes same and further formed with a purge port 244. This latter mentioned port 244 communicates with the reservoir 226 via an overflow conduit 246.

A normally closed ON/OFF type electromagnetic valve 248 is disposed in conduit 246 and arranged to be open only when energized. Also communicating with the riser 240 is a pressure differential responsive diaphragm operated switch arrangement 250 which assumes an open state upon the pressure prevailing within the cooling circuit (viz. the coolant jacket 208, vapor manifold 214, vapor conduit 214, radiator 216 and return conduit) dropping below atmospheric pressure by a predetermined amount. In this embodiment the switch 250 is arranged to open upon the pressure in the cooling circuit falling to a level in the order of −30 to −50 mmHg.

In order to control the level of coolant in the coolant jacket, a level sensor 252 is disposed as shown. It will be noted that this sensor 252 is located at a level (H1) which is higher than that of the combustion chambers, exhaust ports and valves (structure subject to high heat flux) so as to maintain same securely immersed in liquid coolant and therefore attenuate engine knocking and the like due to the formation of localized zones of abnormally high temperature or 'hot spots'.

Located below the level sensor 252 so as to be immersed in the liquid coolant is a temperature sensor 254. The output of the level sensor 252 and the temperature sensor 254 are fed to a control circuit 256 or modulator which is suitably connected with a source of EMF (not shown).

The control circuit 256 further receives an input from the engine distributor 258 (or like device) which outputs a signal indicative of engine speed and an input from a load sensing device 260 such as a throttle valve position sensor. It will be noted that as an alternative to throttle position, the output of an air flow meter, an induction vacuum sensor or the pulse width of fuel injection control signal may be used to indicate load.

A second level sensor 262 is disposed in the lower tank 220 at a level H1. The purpose for the provision of this sensor will become clear hereinafter when a discussion the operation of the embodiment is made with reference to the flow charts of FIGS. 9 to 20. An alarm unit 264 is arranged to be energizale in a manner to bring to the attention of the vehicle operator that a mulfunction has occurred. This alarm unit may include a lamp, buzzer or a voice warning system.

OPERATION OVERVIEW

Prior to use the cooling circuit is filled to the brim with coolant (for example water or a mixture of water and antifreeze or the like) and the cap 242 securely set in place to seal the system. A suitable quantity of additional coolant is also placed in the reservoir 225. At this time the electromagnetic valve 230 should be temporarily energized so as to assume a closed condition. Alternatively, and/or in combination with the above, it is possible to introduce coolant into the reservoir 225 and manually energize valve 236 in a manner to establish flow path B while simultaneously energizing pump 224 so as induct coolant from the reservoir via conduit 238 and pump same into the lower tank 220 until coolant can be visibly seen spilling out of the open riser. By securing the cap 242 in position at this time the system may be sealed in a completely filled state.

To facilate this filling and subsequent servicing of the system a manually operable switch may be arranged to permit the above operation from 'under the hood' and without the need to actually start the engine.

When the engine is started, as the coolant jacket is completely filled with stagnant coolant, the heat produced by the combustion in the combustion chambers cannot be readily released via the radiator 216 to the ambient atmosphere and the coolant rapidly warms and begins to produce coolant vapor. At this time valve 230 is left de-energized (open) whereby the pressure of the coolant vapor begins displacing liquid coolant out of the cooling circuit (viz., the coolant jacket 208, vapor manifold 212, vapor conduit 214, radiator 216, lower tank 220 and return conduit 222).

During this 'coolant displacement mode' it is possible for either of two situations to occur. That is to say, it is possible for the level of coolant in the coolant jacket 208 to be reduced to level H1 before the level in the radiator 216 reaches level H2 or vice versa, viz., wherein the radiator 216 is emptied to level H2 before much of the coolant in the coolant jacket 208 is displaced. In the event that latter occurs (viz., the coolant level in the radiator falls to H1 before that in the coolant jacket reaches H1), valve 230 is temporarily closed and an amount of the excess coolant in the coolant jacket 208 allowed to 'distill' over to the radiator 216 before valve 230 is reopened. Alternatively, if the level H1 is reached first, level sensor 252 induces the energization of pump 224 and coolant is pumped from the lower tank 220 to the coolant jacket 208 while simultaneously being displaced out through conduit 228 to reservoir 226.

The load and other operational parameters of the engine (viz., the outputs of the sensors 258 and 260) are sampled and a decision made as to the temperature at which the coolant should be controlled to boil. If the desired temperature is reached before the amount of the coolant in the cooling circuit is reduced to its minimum permissible level (viz., when the coolant in the coolant jacket and the radiator are at levels H1 and H2 respectively) it is possible to energize valve 230 so that is assumes a closed state and places the cooling circuit in a hermetically closed condition. If the temperature at which the coolant boils should exceed that determined to be best suited for the instant set of engine operational conditions, three-way valve 256 may be set to establish flow path A and the pump 224 energized briefly to pump a quantity of coolant out of the cooling circuit to increase the surface 'dry' (internal) surface area of the radiator 216 available for the coolant vapor to release its latent heat of evaporation and to simultaneously lower the pressure prevailing within the cooling circuit. It should be noted however, that upon the coolant in the circuit being reduced to the minimum level (viz., when the levels in the coolant jacket 258 and the lower tank 220 assumes levels H1 and H2 respectively) the displacement of coolant from the circuit is terminated in order to prevent a possible shortage of coolant in the coolant jacket 208.

On the other hand, should the ambient conditions be such that the rate of condensation in the radiator 216 is higher than that desired (viz., be subject to overcooling) and the pressure within the system overly lowered to assume a sub-atmospheric level, three-way valve 236 is conditioned to produce flow path A and the pump 224 operated to induct coolant from the reservoir 226 and force same into the radiator 216 via the lower tank 220 until it rises to a suitable level. With this measure, the pressure prevailing in the cooling circuit is raised and the surface area available for heat exchange reduced.

Accordingly, the boiling point of the coolant is immediately modified by the change in internal pressure while the amount of heat which may be released from the system reduced. Accordingly, it is possible to rapidly elevate the boiling point to that determined to be necessary.

When the engine 200 is stopped it is advantageous to maintain valve 230 energized (viz., closed) until the pressure differential responsive switch arrangement 250 opens. This obviates the problem wherein large amounts of coolant are violently discharged from the cooling circuit due to the presence of superatmospheric pressures therein.

The above briefly disclosed operations will become more clearly understood as the description of the flow charts shown in FIGS. 9 to 20 proceeds.

SYSTEM CONTROL ROUTINE

Figure 9A:
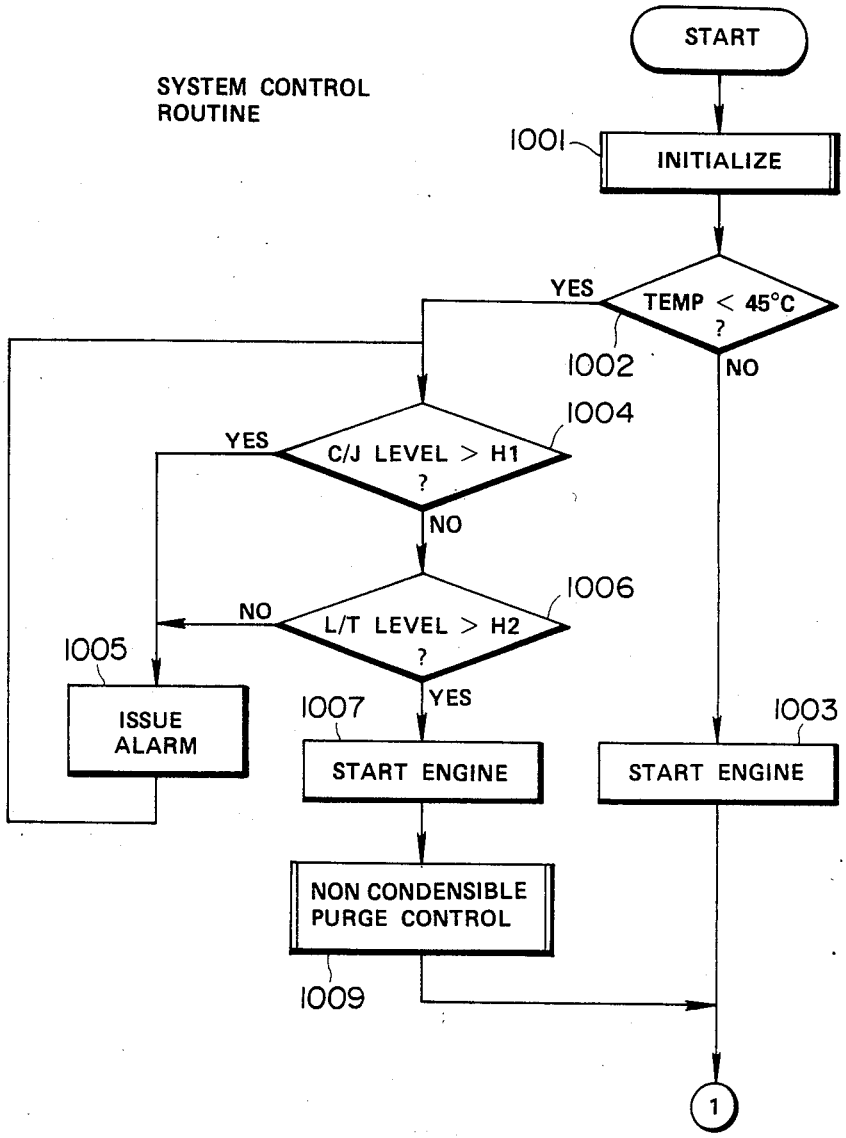
FIGS. 9A–20 are flow charts depicting the steps which characterize the operation of the FIG. 8 arrangement.
Figure 9B:
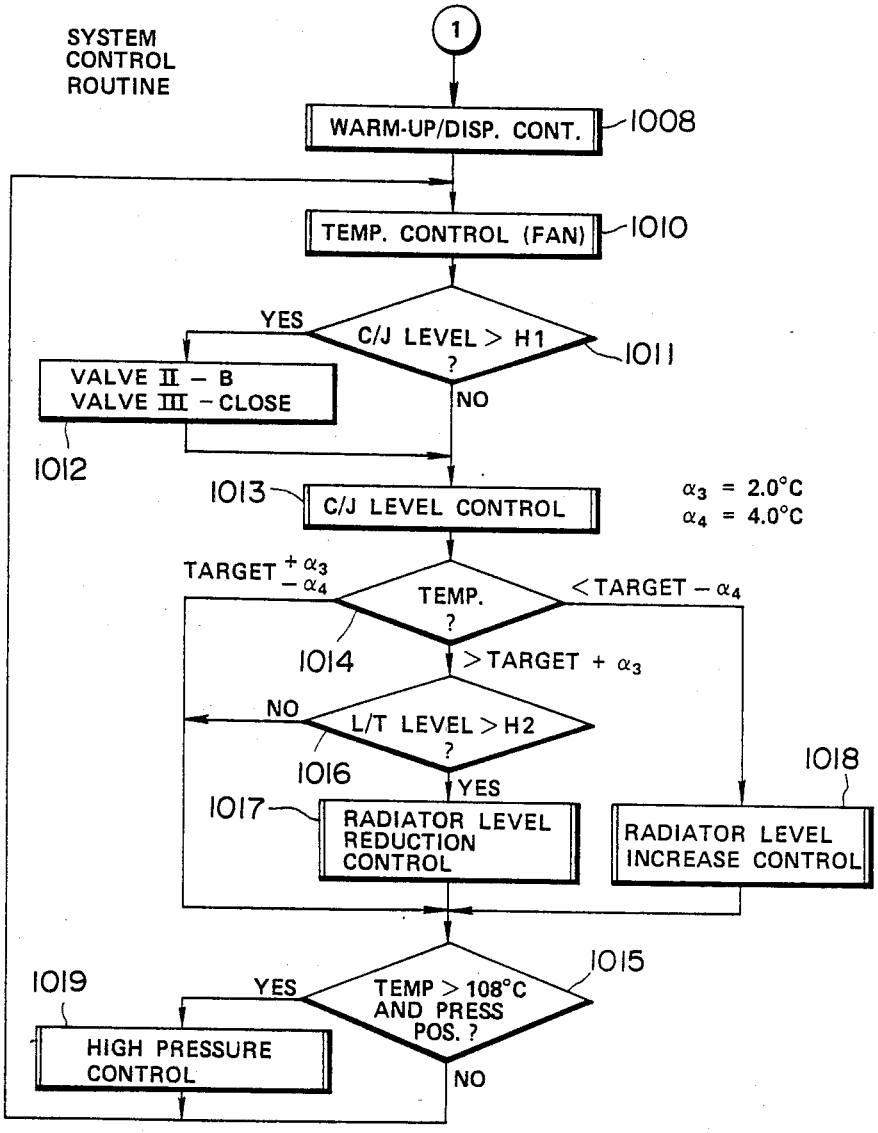
Figure 10:
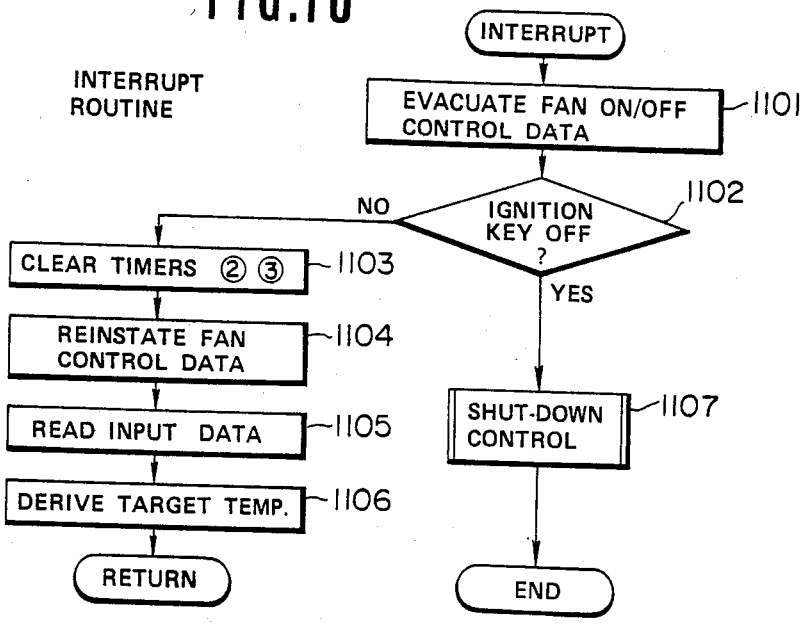

FIGS. 9A and 9B show a system control routine which illustrates the steps which characterize the overall control of the cooling system. FIG. 9A shows the steps which characterize a first embodiment of the present invention.

In this routine following the initialization of the microprocessor (step 1001) and prior the actual start of the engine, the temperature of the engine coolant is sampled at step 1002. In the event that the temperature of the engine coolant as sensed by temperature sensor is above a predetermined minimum valve which is selected in this embodiment to be 45° C., the program flows to step 1003 wherein a command which permits the engine to be started is issued.

On the other hand, if the engine is 'cold' and the temperature below the predetermined limit than the program flows to step 1004 wherein the output of level sensor 252 is sampled to determine if the level of coolant in the coolant jacket 208 is above level H1 or not. As the cooling circuit should be essentially full of liquid coolant at this temperature, an output from sensor 252 indicating that the level of coolant is below H1 can be taken as an indication that this sensor is malfuctioning and the program flows to step 1005 wherein an alarm is generated. This alarm may take the form of the energization of a warning lamp, buzzer and /or voice warning system or the like. Following the issuance of the warning the program flows back to step 1004 to again check the coolant jacket level sensor output 252 and thus recheck the malfunction detection.

At step 1006 a similar check routine is implemented with respect to the output of the lower tank level sensor 262. Again under cold engine start conditions if the output of this level sensor is such as to indicate a low level, either the cooling circuit is almost empty of liquid coolant or the sensor is out of order and hence in either instance the issuance of a malfunction warning is in order.

In the event that either of the two sensors are found to be malfunctioning it is peferable to not permit the engine to be started and thus, unless both of the sensors are deemed to be in order, the program is not permitted to flow to step 1007 wherein the engine start-up is enabled.

As will be appreciated with the processing speed possible with IC microprocessors steps 1001 to 1006 can be executed so quickly that the actual delay between the operator issuing the command to start the engine (for example turning the ignition key to the engine crank position) and the start of the engine (or the issuance of a malfunction warning) is not humanly perceptible and thus induces no concern on the operators behalf.

In the event that a warm engine start takes place (step 1003), as the engine is still warm it is deemed that insufficient time has passed for air or the like to have leaked into the system since the engine was last shut-down and program flows directly to step 1008 wherein a routine which controls the displacement of the excess coolant out of the system is implemented. However, in the event of a 'cold' engine start (step 1007) in order to ensure that no build-up of non-condensible matter is permitted to occur, at step 1009 a non-condensible matter is permitted to control mode is entered. In this mode excess coolant is pumped into the system so that as the excess overflows any air or the like is flushed out. Following this the warm-up displacement control of step 1008 is implemented.

At step 1010 a control routine which regulates the temperature of the coolant via selective energization of fan 218 is run. Following this the level of coolant in the coolant jacket 208 is checked in step 1011. If the outcome of this enquiry is such as to indicate that the level in the coolant jacket is above level H1 then at step 1012 valve 11 is conditioned to produce flow path B and valve III closed. This places the system in a closed circuit state with fluid communication between the radiator 216 and the coolant jacket established.

Following both of steps 1011 and 1012 a coolant level control routine is run at step 1013. With this arrangement the level of coolant in the coolant jacket is maintained at H1 irrespective of the system being in a closed circuit condition or not. Following this, the temperature of the coolant in the coolant jacket is sampled by reading the output of the temperature sensor 254 and ranged against a 'target' value which is determined on the basis of the instant mode of engine operation. Viz., if the engine is found to be operating in zone A for example, the value of 'TARGET' is set at a value between 100° and 110° C. The derivation of this value will be dealt with in detail hereinlater in connection with the interrupt routine of FIG. 10.

In the event that the temperature is found to be within a range of TARGET$+\alpha 3$ to TARGET$-\alpha 4$ at step 1014 then the program flows immediately to step 1015. However, if the temperature is above TARGET$+\alpha 3$ then at step 1016 the level of coolant in the lower tank (L/T) 220 is determined by sampling the output of sensor 262 to ascertain whether the reason for the high temperature is excess coolant in the radiator 216 which is reducing the effective heat exchange surface area of the same. If the outcome of this enquiry is negative the program flows to step 1015. However, in the event that some excess coolant is found to be in the radiator then at step 1017 a routine which reduces the level of coolant is run. On the other hand if the outcome of the enquiry conducted at step 1014 indicates that the temperature of the coolant is lower than desired the program flows to step 1018 wherein steps are implemented to increase the amount of coolant in the radiator and thus reduce the amount of dry surface area available for coolant vapor to release its latent heat of evaporation and condense. As will be appreciated steps 1017 and 1018 are such as to control the temperature of the coolant boiling point by tailoring the heat exchange characteristics of the radiator 216 to that suited for the instant set of operational conditions. This, in combination with the temperature control effected by the operation of fan 218, enables rapid and stable control of the coolant temperature.

However, in the event that the control of step 1017 is not effective it is likely that non-condensible matter has appeared in the system and has reduced the efficiency of the radiator 216 to the point of inducing a potential engine overheat condition. Accordingly, both the output of the coolant sensor 254 and the pressure differential switch arrangement 250 are sampled (at step 1015) and in the event that the temperature is above 108° C. and the pressure is superatmospheric then at step 1014 a control routine (step 1019) which performs what shall be referred to as a 'hot purge' is run.

Before dealing with each of the above mentioned routines in detail it is deemed appropriate to firstly discuss the interrupt which is performed at frequent intervals to determine the current operational status of the engine.

INTERRUPT ROUTINE

Each time this routine is run the current fan control data is evacuated from the CPU in order to clear the way for subsequent operations. At step 1102 the status of the ignition key is sampled and in the event that it is ON indicating that the engine is running the program flows to steps 1103 to 1106 Wherein timers 2 and 3 (soft clocks used in shut-down routine) are cleared, the fan control data reinstated in the CPU and the inputs from sensors 258 and 260 read in preparation for the derivation of the 'Target' temperature (step 1106).

As will be appreciated from the discussion of the three zones shown in FIG. 5 as the instant embodiment employs a microprocessor, it is a relatively simple matter to set data such as a two dimensional table of the nature of that shown in said figure in the ROM and use the load and engine speed inputs from sensors 258 and 260 to determine which load and which temperature range should be employed under the instant set of operational conditions. Alternatively, it is possible to develop programs which will perform the same function. As such details are well within the grasp of one skilled in the art of computer programming no further discription will be given for brevity.

However, if at step 1102 it is discovered that the ignition key is OFF then at step 1007 a routine which controls the cooling of the system to the point where it is safe to render the system open circiut without encountering the problem wherein superatmospheric pressure cause a discharge of coolant from the cooling circuit to the reservoir of sufficient violence that coolant is apt to the lost via spillage and/or large quantities of air permitted to enter the system.

Each of the above mentioned sub-routines will now be dealt with one by one with reference to FIGS. 10 to 20.

NON-CONDENSIBLE MATTER PURGE CONTROL ROUTINE (A)

Figure 11:
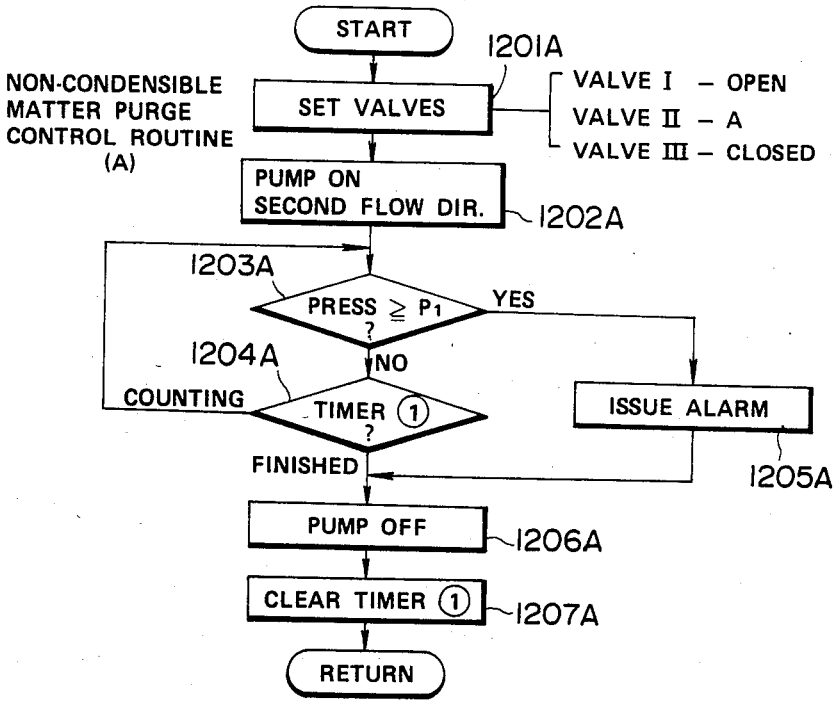

FIG. 11 shows in flow chart form a routine which controls the purging of non-condensibe matter and which features a second embodiment of the present invention. In this embodiment the operability of the overflow conduit valve 248 is checked by sampling the output of the pressure differential responsive device and determining if the hydraulic pressure in the cooling circuit remains below a predetermined level for a predetermined period of time. That is to say, if immediately after the pumping of coolant into the coolant circuit, the pressure rises to a predetermined level (P1) then is assumed that coolant is not being permitted to spill over via the overflow conduit and that a malfuction which prevents the successful execution of the purge operation has occured.

In more detail, following the termination of the check which determines if the system level sensors are operable or not, at step 1201A the control circuit issues commands to open valve I, establish flow path A and close valve III are issued. At step 1202A pump 224 is energized in the second flow direction so as to induct coolant from the reservoir and pump same into the lower tank 220. At this time a soft clock or timer I is set counting over a predetermined period of time. In this embodiment the period is selected to be 10 seconds. However, this period is variable and may set in the order of several seconds, several tens of seconds or as long as 1 minute or more. This period may also be variable in response to the ambient temperature or the like.

At step 1203A the output of the pressure differential device 250 is sampled to determine if the pressure in the cooling circuit is at or above a predetermined limit P1. In the event that the pressure is not above the predetermined limit of P1 then the program flows to step 1204A wherein the count of the soft clock or timer 1 is checked. In the event that the count has not reached the predetermined time then the program recycles. However, if at any time within the predetermined period the pressure in the cooling circuit exceeds P1 then it is assumed that for reasons such as a malfuction of valve 248 overflow conduit is not open and permitting coolant to spill over back to the reservoir 226 as normal and at steps 1205A and 1206A an alarm is issued and operation of pump 224 stopped.

Upon termination of the count the program flows to steps 1206A and 1207A wherein the operation of pump 224 is stopped and timer I cleared ready for the next purge operation.

NON-CONDENSIBLE MATTER PURGE CONTROL ROUTINE (B)

Figure 12:
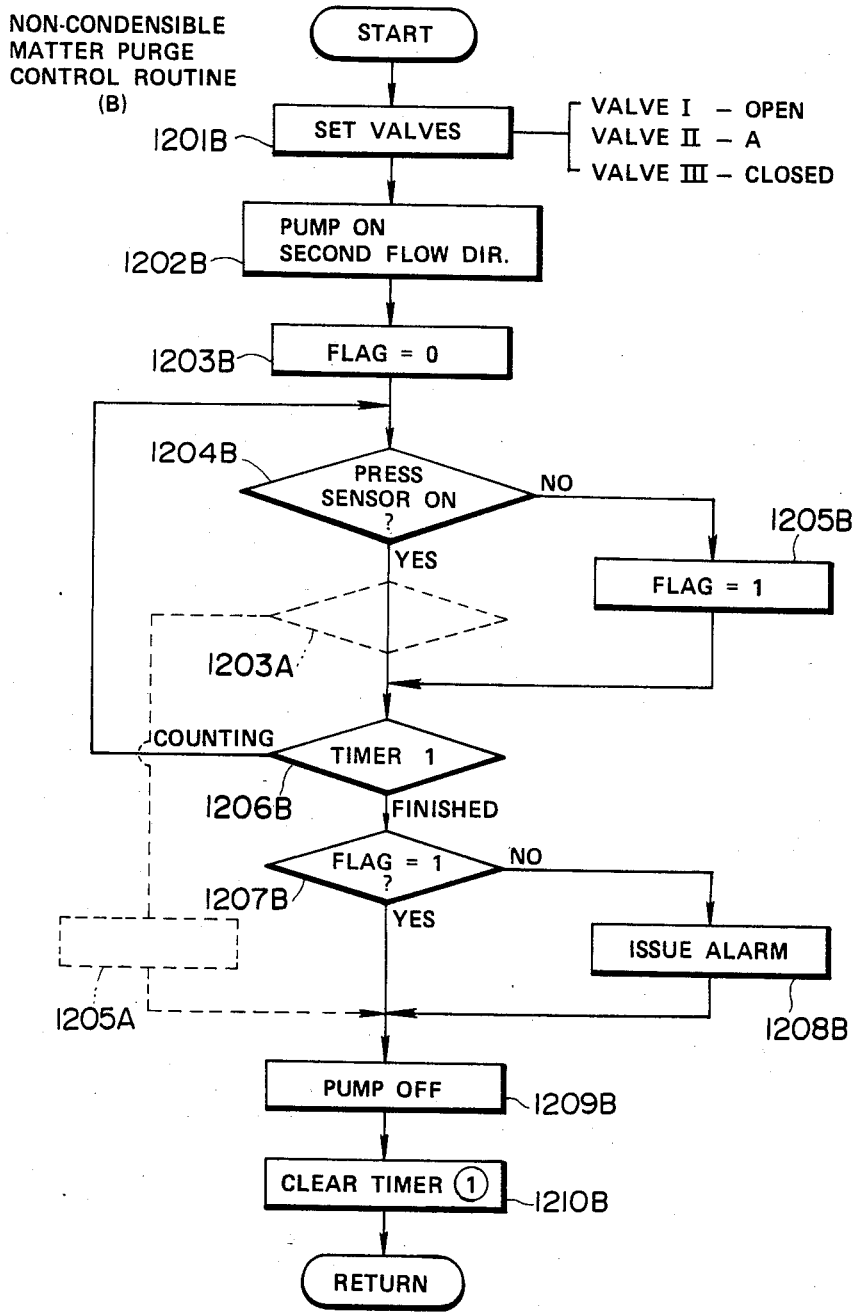

FIG. 12 shows in flow chart form a second control routine for purging air and the like from the cooling circuit. This routine features a third embodiment of the present invention wherein the operability of the pressure differential responsive device 250 is checked.

As will be readily appreciated, the first two steps of this routine are the same as that of the routine shown in FIG. 11. At step 1203B a flag is set equal to zero and at step 1204B the output of the pressure differential responsive device or pressure sensor as it will be referred to hereinafter, is sampled. In the event that the output of the sensor is such as to indicate that the pressure in the cooling circuit has not risen to the slightly superatmospheric level indicative of the the coolant jacket having been completely filled with liquid coolant and a slight pressurization having occured due to the orifice or flow restricting effect which occurs as a result of the length of the overflow conduit and the provision of the ON/-OFF valve therein, then the program flows to step 1205B wherein the flag of step 1203B is changed to '1'. On the other hand, if the pressure has risen to the above mentioned value then at step 1206B the count of the timer set in step 1202B is checked. In the event that the predetermined period (in this case 10 seconds) has not expired and the counter is still counting the program recycles to step 1204B.

Upon timer having completed its count the program flows to step 1207B wherein the status of the flag is checked. With the second embodiment if all is normal then by the end of the purge period the cooling circuit should be completely full and the system slightly pressurized due to the above mentioned flow restricting effect of the overflow conduit and associated elements. Thus, if at this time the flag has not been set to '1' then it is assumed that there is a malfunction in the system. Viz., either the cooling circuit is not completely filled with liquid coolant or the pressure sensor is malfuctioning. Accordingly, in the event that the enquiry performed at step 1207B indicates that flag=0 then at step 1208B an alarm is issued. As the operation of the pressure sensor is not instantly critical to the operation of the system a fuel cut-off or the like is not performed.

At steps 1209B and 1210B the operation of the pump is stopped and timer I cleared.

In the event that it is desired to combine the second and third embodiments it is possible to arrange for steps 1203A and 1205A to be introduced to the above described routine as shown in chain line. However, as will be appreciated under these circumstances it is necessary to arranged for the pressure sensor to be responsive to two discrete levels of pressure. That is to say, it is necessary for the sensor to be able to output a first signal indicative of the above mentioned slight pressurization of the cooling circuit in response to the latter being completely filled and a second signal indicative of pressure P1 which by definition must be higher than said 'slight' level and be indicative of the system being 'pumped up' with the overflow conduit closed due to a malfuction. In this instance it is a simple matter to determine which of the problems has occured as the likelyhood of both having simultaneously occured is extremely low.

WARM-UP/DISPLACEMENT CONTROL ROUTINE

Figure 13:
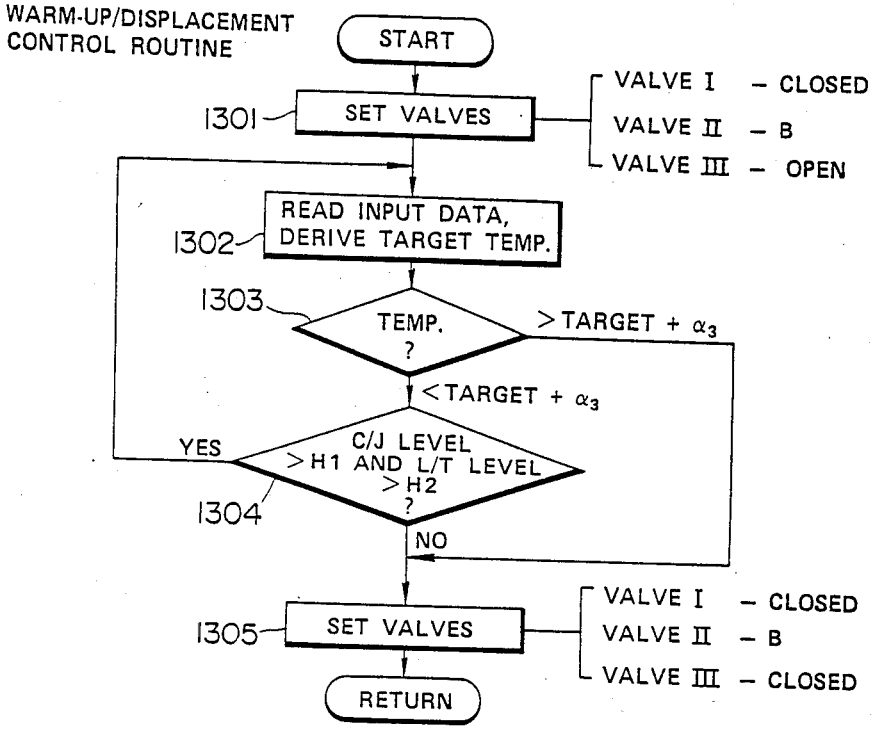

FIG. 13 shows the control steps which characterize the control of the 'warm-up/displacement' control mode of operation. As shown in step 1301 valves I, II and III (i.e. valves 248, 236 and 230) are conditioned in a manner which closes the overflow conduit establishes flow path B and which de-energizes valve III (230) to open conduit 228. At step 1302 the data input from the sensors 258 and 260 are read and a determination made as to the most appropriate temperature for the coolant to be induced to boil, via calculation or otherwise suitably looked-up.

At step 1303 the output of the coolant temperature sensor 254 is sampled and compared with the TARGET value determined in step 1302. If the coolant temperature is above TARGET by a value $\alpha 3$ (wherein $\alpha=2.0°$ C.) then the program flows to step 1305 while in the event that the coolant temperature has not come within TARGET$+\alpha 3$ then at step 1304 the output of level sensors 252 and 262 are sampled and it is determined if the level of coolant in both of the coolant jacket 208 (C/J) and the lower tank 220 (L/T) are below levels H1 and H2 respectively. If the outcome of this enquiry is negative, then the coolant circuit is considered to still contain an amount of coolant in excess of the above mentioned minimum amount and the program recycles to step 1302 to allow for further displacement. However, if one of the levels has reached the respective predetermined value, then in order to prevent either an excessively low level in the coolant jacket 208 or for the excess coolant in the coolant jacket to be in part moved to the radiator 216 via the previously mentioned 'distillation' process, the valves are conditioned as shown. Viz., valve I is closed, valve II flow path B is established and valve III is energized to assume a closed state.

Following the return of the warm-up/ displacment control mode the temperature control (fan) program is run.

TEMPERATURE CONTROL ROUTINE

Figure 14:
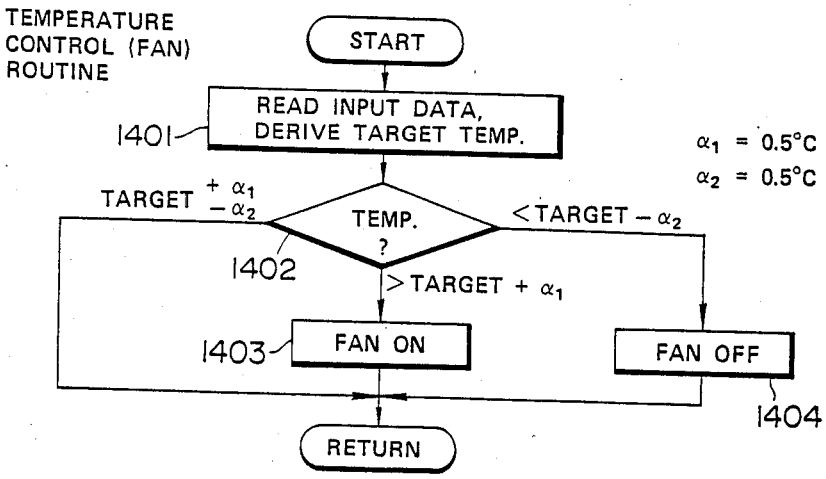

As shown in FIG. 14, at step 1401 of this routine the data inputs from sensors 258 and 260 are read and the TARGET temperature determined. At step 1402 the instant collant temperature is determined by sampling the output of temperature sensor 254 and compared with the derived TARGET value. The temperature is ranged as shown. Accordingly, if the instant coolant temperature is within a range of TARGET$+\alpha 1$ to TARGET$-\alpha 3$ (wherein $\alpha 1=0.5°$ C.$=\alpha 2$) then the routine terminates. However, if the temperature is lower than TARGET$-\alpha 2$ then the operation of the cooling fan 218 is prevented while if above TARGET$+\alpha 1$ then at step 1403 a command to energize fan 218 is issued.

COOLANT LEVEL CONTROL ROUTINE

Figure 15:
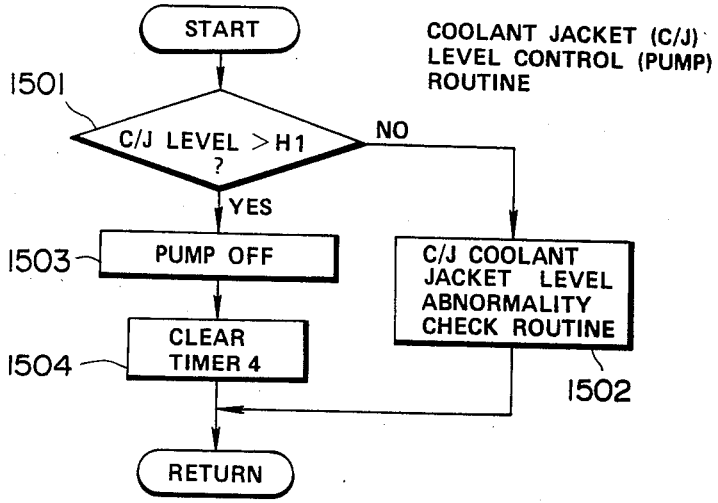

FIG. 15 shows the coolant level control routine which is run after each temperature control rountine execution. At step 1501 of this program the level of the coolant in the coolant jacket 208 is determined by sampling the output of level sensor 252. If the level of coolant in the coolant jacket 208 (C/J) is below H1 then at step 1502 a coolant jacket level abnormality check routine is run. However, if the level of coolant is found to be above sensor 262 then at step 1503 a comand to stop the operation of pump 224 is issued. Following this timer 4 (used in the abnormality check routine) is cleared in step 1504 and the routine returns.

COOLANT JACKET LEVEL ABNORMALITY CHECK ROUTINE

Figure 16:
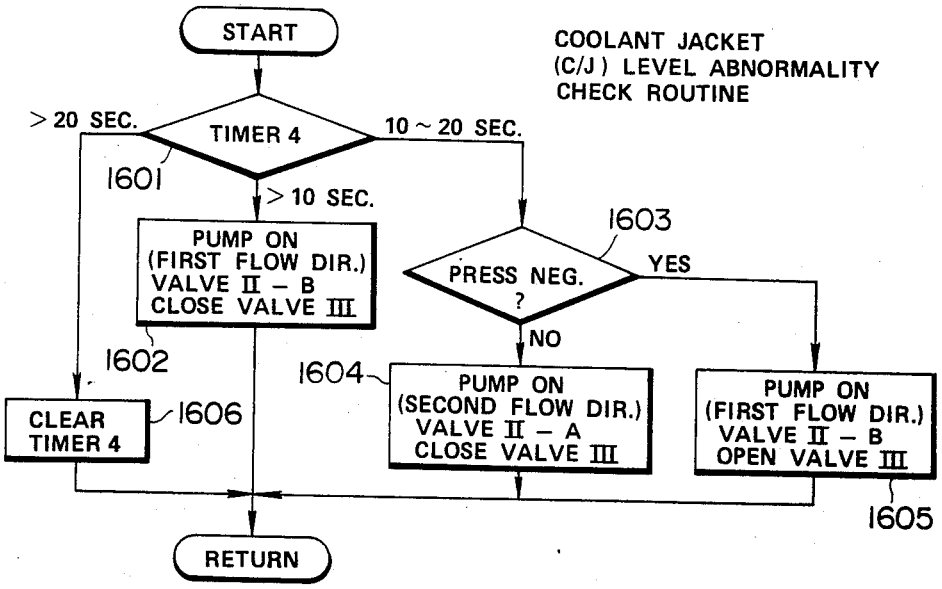

As shown in FIG. 16 the first step 1601 of this routine is such as set timer 4 counting. While the count is below 10 seconds the program flows to step 1602 wherein pump 224 is energized to pump in the first flow direction while valve II is set to provide flow path B and valve III is closed. With the system thus conditioned coolant is pumped in a normal manner from the lower tank 220 to the coolant jacket 208. Upon the count of timer 4 entering a period between 10 and 20 seconds the program flows to step 1603 Wherein the output of the pressure differential switch arrangement 250 is sampled and a determination made as to whether the pressure within the system is negative or not. In the event that the pressure is not negative then at step 1604 pump 224 is energized in the second flow direction valve II set to produce flow path A and valve III closed. In this state the system is conditioned to force coolant out of the cooling circuit to the reservoir 226. On the other hand, if the pressure in the system is found to be negative at step 1603 then as shown the flow path is established, pump 254 induced to pump in the first flow direction and valve III opened. Under these conditions the system permits coolant to be inducted under the influence of the pressure differential which prevails between the atmosphere and the interior of the cooling circuit.

As will be understood step 1604 is such as to reduce the amount of coolant contained in the cooling circuit while step 1605 is such as to increase the same.

Upon the count of timer 4 exceeding 20 seconds the program flows to step 1606 wherein timer 4 is cleared.

RADIATOR LEVEL REDUCTION CONTROL ROUTINE

Figure 17:
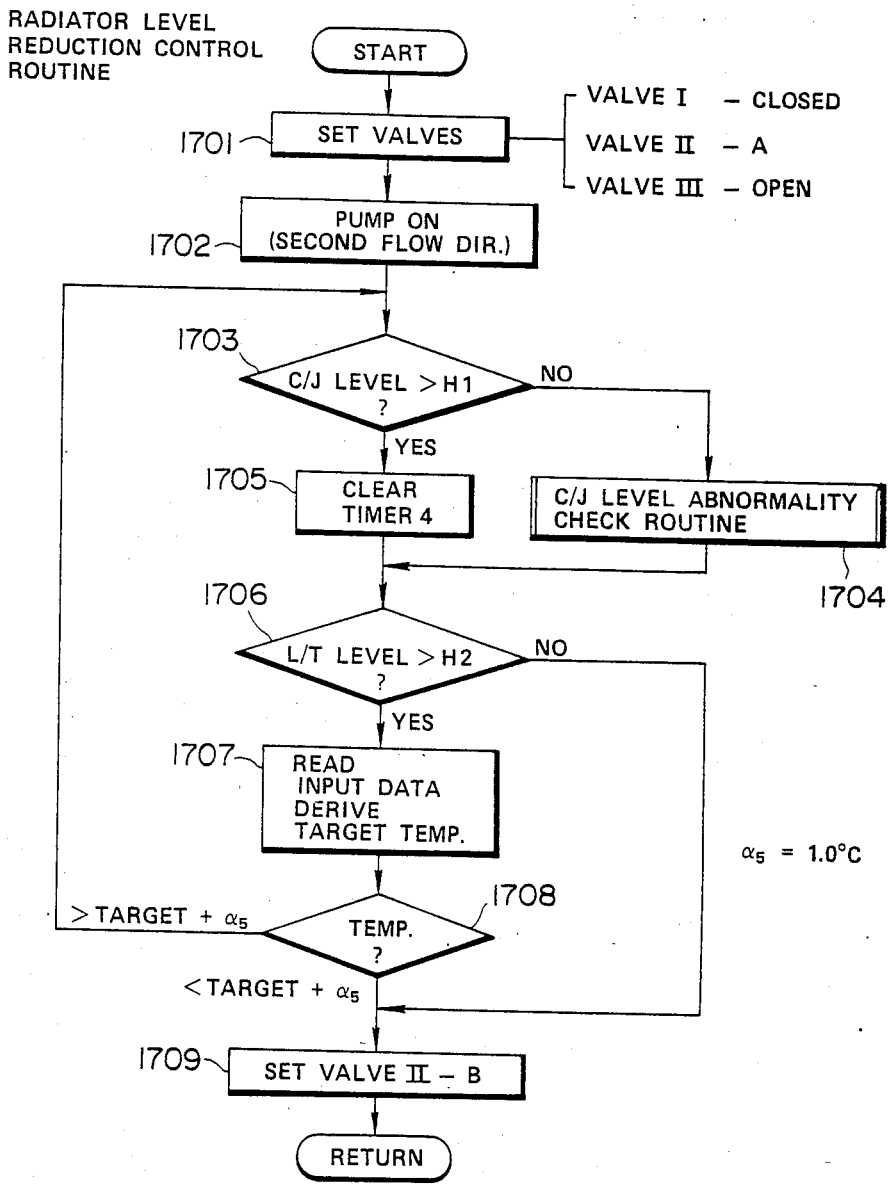

FIG. 17 shows in flow chart form the steps which characterize the control via which the level of coolant in the cooling circuit is reduced for the purposes of coolant temperature control. As shown the first step (1701) of this control routine involves the conditioning of the valves so that valve I is closed, valve II establishes flow path A and valve III is energized to assume a closed state. At step 1702 pump 224 is energized so as pump coolant in the second flow direction (viz., from the lower tank toward valve II (236). Under these conditions coolant is withdrawn from the lower tank 220 and forced out to the reservoir 226 via conduit 238.

At step 1703 the coolant level in the coolant jacket 208 is checked to determine if the level of coolant therein has dropped to H1 or not. In the event that the level has not dropped to H1 then the program flows to step 1704 wherein the coolant jacket abnormality chech routine is implemented. On the other hand, if the level in the coolant jacket has in fact dropped to level H1 then at step 1705 a command to clear timer 4 is issued and at step 1706 the coolant level in the lower tank 220 is determined by sampling the output of level sensor 262. In the event that the level of coolant in the lower tank 220 is below level H2 then the program proceeds to step 1707 wherein the outputs of sensors 258 and 260 are sampled and the TARGET temperature determined. However, if the level of coolant in the lower tank 220 is still above H2 then the program by-passes steps 1707 and 1708 as shown.

At step 1708 the instant coolant temperature is compared with the TARGET value derived in step 1702. In the event that the coolant temperature is greater than TARGET$+\alpha 5$ (wherein $\alpha 5=1.0°$ C.) then the program returns to step 1703 in an effort to induce a further reduction in coolant and thus internal pressure while in the event that the coolant temperature is lower than TARGET$+\alpha 5$ then the program flows to step 1709 wherein flow path B is established via suitable conditioning of valve II.

As will be appreciated this control strives to lower the temperature of the coolant to a value which is within 1.0° C. of the desired TARGET value and is executed in response to the temperature ranging and level sensing steps 1014 and 1016 of the system control routine shown in FIG. 9B.

RADIATOR LEVEL INCREASE CONTROL ROUTINE

Figure 18:
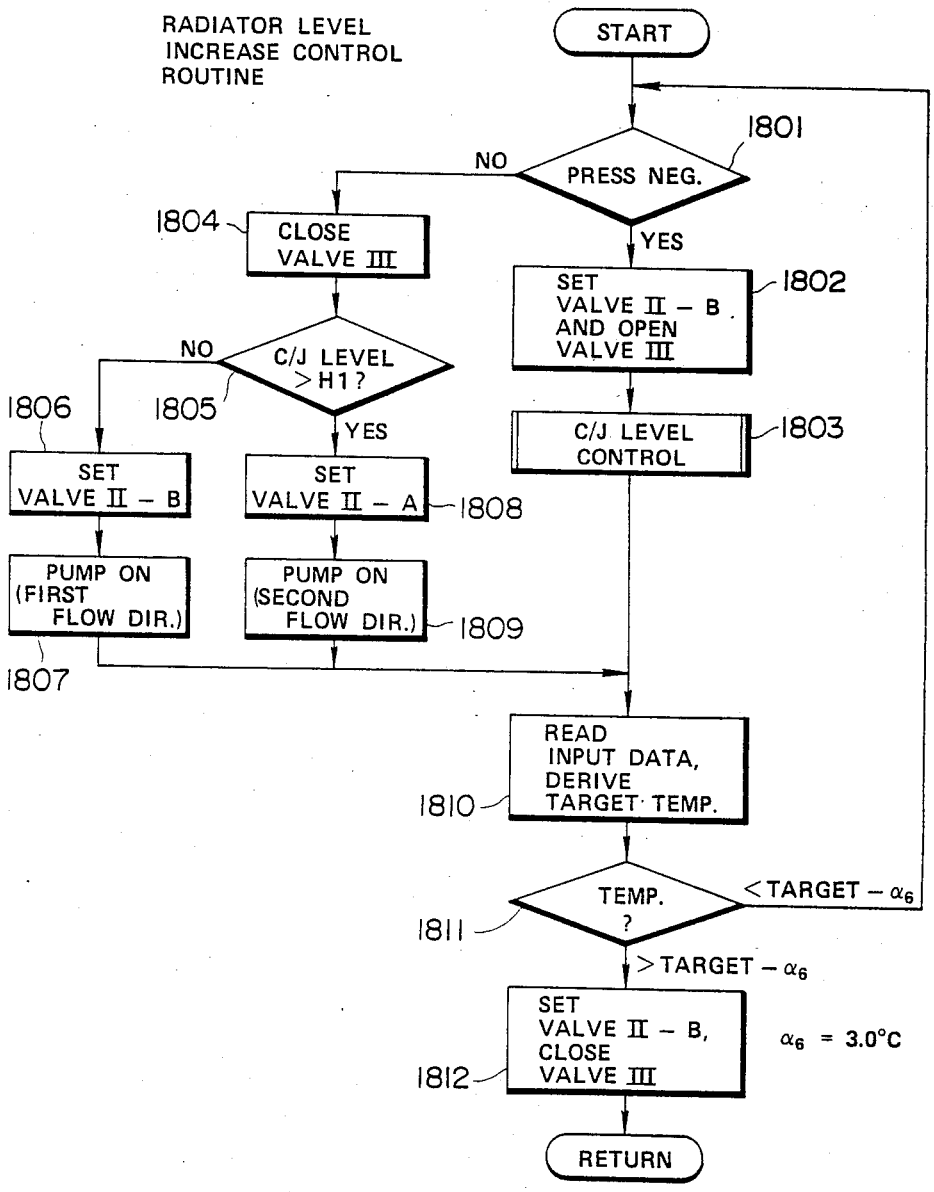
Figure 19:
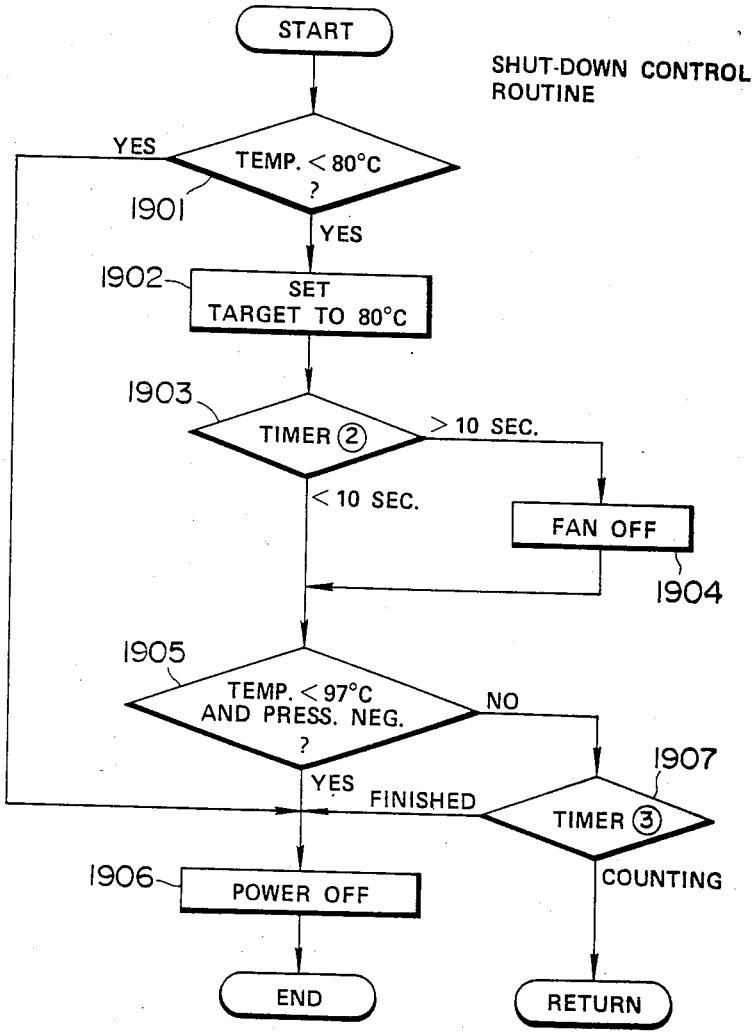

FIG. 18 shows in detail the steps which characterize the operation wherein the amount of coolant within the cooling circuit is increased in an effort to raise the pressure within the cooling circuit and thus raise the boiling point of the coolant. It will be noted that this control is executed in response to the temperature ranging executed in step 1014 of FIG. 9B.

As shown, subsequent to the start of this routine the pressure prevailing in the cooling circuit is sampled and the determination as to whether the pressure is negative of not (step 1801). This of course can be determined by sampling the output of the pressure differential responsive switch 250.

In the event that the pressure within the cooling circuit is in fact negative then the program proceeds to step 1802 wherein valve II is condition to provide flow path B while valve III is de-energized to assume an open state. This permits coolant to be inducted into the coolant circuit under the influence of the pressure differential which exists between the ambient atmosphere and the interior of the cooling system. At step 1803 the coolant level control routine shown in FIG. 15 is executed.

On the other hand, if the pressure within the cooling circuit is not lower than atmospheric then at step 1804 valve III is energized so as to assume a closed state. At step 1805 the coolant level in the coolant jacket 208 is determined and if lower than H1 then at step 1806 valve II is conditioned to provide flow path B and at step 1807 pump 224 is energized in a manner to pump liquid coolant in the first flow direction. However, if the coolant level in the coolant jacket 208 is above H1 then flow path A is established and pump 224 operated to pump coolant in the second flow direction. This of course positively inducts coolant from the reservoir 226 and forces same into the cooling circuit (radiator 216) to increase the pressure prevailing therein.

At step 1810 the TARGET temperature is derived and at step 1811 the instant coolant temperature compared with the derived value. In the event that the coolant temperature is below TARGET$-\alpha 6$ then the program recycles to step 1801 in order to permit further coolant to be introduced into the cooling circuit.

However, if the temperature is greater than TARGET$-\alpha 6$ then at step 1812 flow path B is established and valve III closed thus terminating the influx of coolant.

SHUT-DOWN CONTROL ROUTINE

At step 1901 it is determined if the temperature of the engine coolant is above a predetemined level which in this embodiment is selected to be 80° C. If the temperature of the coolant is still below the just mentioned limit it is assumed that the cooling circuit can be rendered open circuit without fear of super atmospheric pressures causing a violent displacement of coolant out of the circuit to the reservoir in a manner which invites spillage and permanent loss of coolant. On the other hand, if the coolant is still above 80° C. then the program flows to step 1902 wherein the TARGET temperature is set to the just mentioned value. At step 1903 a second timer (timer 2) is set counting. In this embodiment the period for which the second counter is arranged to count over is selected to be 1 minute. If desired this value can be increased or decreased in view of the engine which is cooled by the system according to the present invention. Upon completion of the count the operation of fan 218 is terminated in step 1904.

At step 1905 enquiries relating to the temperature and pressure status of the interior of the cooling circuit are carried out. Viz., it is determined if the coolant temperature is below 97° C. and the pressure prevailing within the system negative.

If both of these requirements are met then at step 1906 power to the entire system is cut off. However, if one or the other of the two requirements is not met then the program flows to step 1907 wherein timer 3 is set counting and the program goes to RETURN. The period for which the third counter is arranged to count is in this embodiment is 1 minute. When the third counter completes its count the program is permitted to go to step 1906 and terminate. Thus, as will be understood, if counter 3 is set counting the shut-down control routine may be run a number of times before the power to the entire system is cut-off. This of course ensures that the above mentioned spillage etc., will not occur.

ABNORMALLY HIGH TEMPERATURE CONTROL ROUTINE

Figure 20:
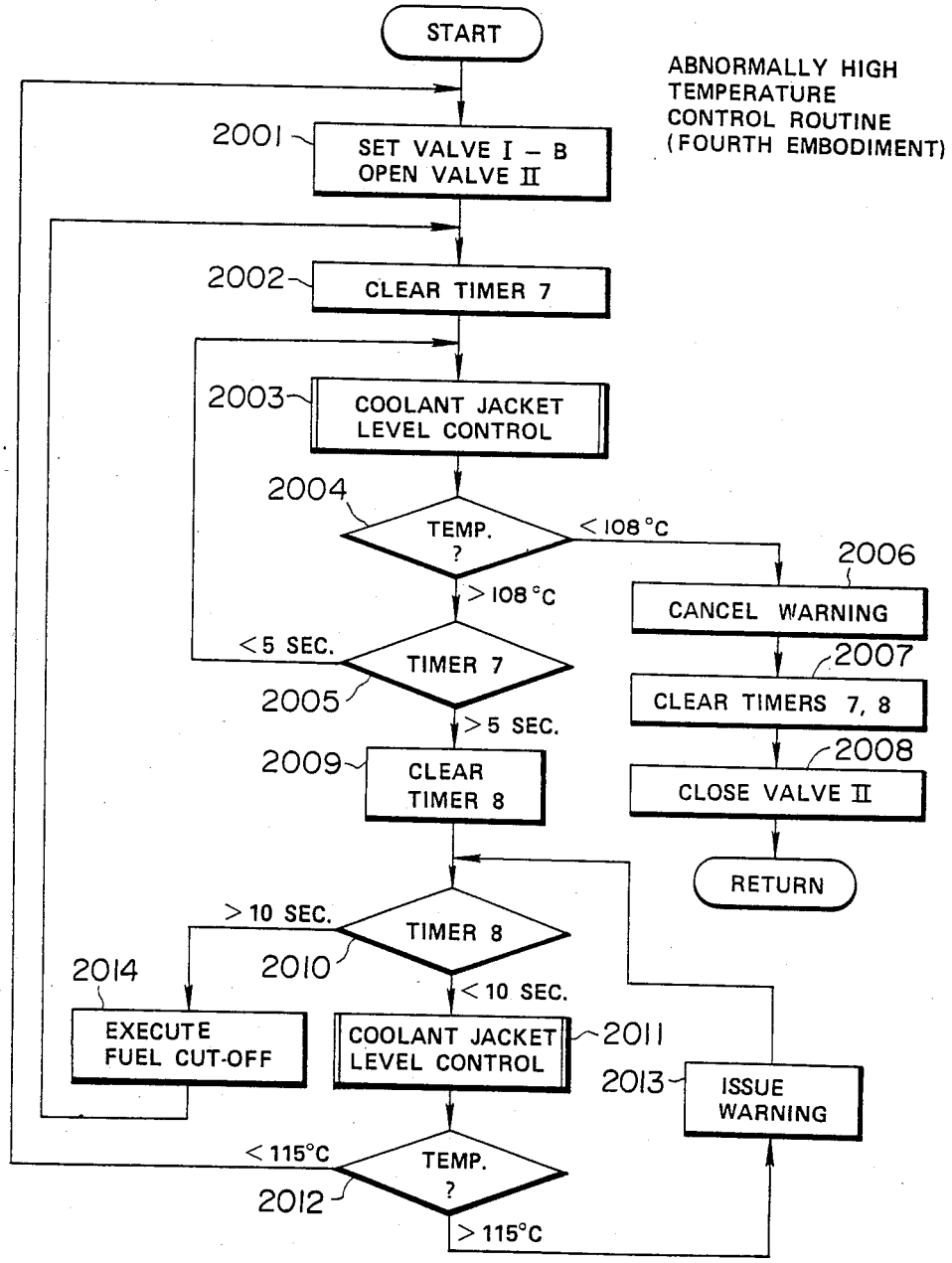

This control routine as shown in FIG. 20 is such that at step 2001 the cooling circuit is rendered open circuit by opening valve and maintaining valve 234 set to provide communication between the lower tank 218 and the coolant jacket 206 (flow path B). At step 2002 a soft clock 'timer 7' is cleared and at step 2003 the coolant jacket level control routine is run. Following this at step 2004, the output of temperature sensor 268 is sampled and in the event that the coolant temperature is found to be greater than 108° C. timer 7 is set counting in step 2005.

If the temperature of the coolant drops below 108° C. within five seconds then the program goes to step 2006 wherein a command to terminate the issuance of a high temperature warning is issued and thereafter flows to steps 2007 and 2009 wherein timers 7 and 8 are cleared and valve II is closed to return the system to a closed circuit state again.

However, if the high temperature persists for more than 5 seconds then at step 2009 timer 8 is cleared and subsequently started in the next step (2010). As will be noted timer 8 is arranged to count over a period corresponding to 10 seconds. While the count remains within this period the program goes to step 2011 wherein the level of coolant in the coolant jacket 206 is monitored and adjusted to level H1; and thereafter goes to step 2012 wherein the temperature is ranged against a maximum permissible value of (in this case) 115° C. If the temperature is above this level the program recycles to step 2010 and issues a warning indicating the very high temperature (step 2011). If this high temperature condition cannot be brought under control either by the driver reducing speed in response to the warning issued in step 2013 or automatically by the system within a period of 10 seconds then at step 2014 a command to execute a partial fuel cut-off is issued in order to reduce the maximum vehicle speed to 50 km/hr (for example) in an effort to obviate any extensive thermal damage or the like to the engine. It will be noted that the fuel cut-off command is preferably not cancelable by the software as the possibility of a major system malfunction is quite high.

What is claimed is:

1. In an internal combustion engine having a structure subject to high heat flux:

a cooling system comprising:

(a) a cooling circuit which includes:

(i) a coolant jacket disposed about said structure, said coolant jacket being arranged to receive coolant in liquid form and discharge same in gaseous form;

(ii) a radiator in fluid communication with said coolant jacket for receiving the coolant vapor produced in said coolant jacket and condensing same to a condensate; and (iii) means for returning the condensate formed in said radiator to said coolant jacket in a manner which maintains said structure immersed in predetermined depth of liquid coolant;

(b) a sensor responsive to a parameter which varies with the amount of coolant in said cooling circuit; and (c) a control circuit including means for monitoring the output of said sensor and for within a predetermined period of one of (a) a demand for engine operation and (b) the initiation of engine operation, diagnosing a malfuntion in the cooling system and issuing a signal indicative thereof.

2. A cooling circuit as claimed in claim 1, wherein said condensate return means comprises:

a first level sensor disposed in said coolant jacket for sensing the level of coolant at a first predetermined level, said first predetermined level being selected to be such that when the level of coolant is thereat said structure is immersed in a predetermined depth of liquid coolant;

a coolant return conduit leading from said radiator to said coolant jacket; and a coolant return pump disposed in said coolant return conduit, said coolant return pump being selectively energizable in respose to the output of said first level sensor in a manner to maintain the level of coolant in said coolant jacket at said first predetermined level.

3. A cooling circuit as claimed in claim 2, wherein said sensor takes the form of said first level sensor, and wherein said monitoring means samples the output of said first level sensor in response to a demand to start the engine and which in the event that the temperature of coolant is below a predetermined level and the output of said first level sensor indicates that the level of coolant in said coolant jacket is below said first predetermined level, said monitoring means issues a signal indicative of a system malfunction.

4. A cooling circuit as claimed in claim 2, wherein said sensor takes the form of a second level sensor which is disposed in a small collection vessel at the bottom of said radiator, said second level sensor being arranged to sense the level of coolant being at a second predetermined level which is lower than the bottom of said radiator, and wherein said monitoring means samples the output of said second level sensor in response to a demand to start the engine and which in the event that the temperature of coolant is below a predetermined level and the output of said second level sensor indicates that the level of coolant in the collection vessel is below said second predetermined level, said monitoring means issues a signal indicative of a system malfunction.

5. A cooling system as claimed in claim 4, further comprising:

a reservoir; and valve and conduit means for providing fluid communication between said cooling circuit and said reservoir in a manner which permits:

(a) said cooling circuit to filled with liquid coolant when the engine is stopped and the temperature of the coolant is below a predetermined value; and (b) for coolant to be pumped into the cooling circuit from said radiator in a manner that the cooling circuit is overfilled with coolant and the exess allowed to overflow in a manner which purges out any non-condensible matter which might have contaminated the cooling circuit.

6. A cooling system as claimed in claim 5, wherein said sensor takes the form of a pressure differential device which is arranged to be responsive to the pressure differential which exits between the interior of said cooling circuit and the ambient atmosphere, said pressure differential responsive device being arranged to output a signal indictive of a predetermined pressure prevailing in said cooling circuit and wherein said monitoring means samples the output of said pressure responsive device when said valve and conduit means is conditioned to overfill the cooling circuit and determines the presence of a system malfuction in the event that the output characteristics fall outside of a range determined to define normal malfunction free system operation.

7. A cooling system as claimed in claim 6, wherein said predetermined pressure is a pressure indicative of the cooling circuit being completely filled and a hydraulic pressure developed due to the flow resistance of said valve and conduit means.

8. A cooling system as claimed in claim 6, wherein said predetermined pressure is a pressure indicative of the cooling circuit being completely filled and said valve and conduit means being inoperative to allow the excess coolant being introduced into said cooling circuit to overflow to said reservoir.

9. A cooling circuit as claimed in claim 5, wherein said valve and conduit means comprises:

a first valve disposed in said coolant return conduit at a location between said coolant return pump and said coolant jacket;

a first conduit leading from said first valve to said reservoir;

said first valve having a first position wherein communication between said pump and said reservoir via said first conduit is established and communication between said pump and said coolant jacket is interrupted, and a second position wherein communication between said pump and said coolant jacket is established and communication between said pump and said reservoir interrupted;

a second conduit leading from said reservoir to a said small collection vessel disposed at the bottom of said radiator;

a second valve disposed in said second conduit, said second valve having a first position wherein communication between said vessel and said radiator is interrupted and a second position wherein the communication is established;

a third conduit leading from the top of said cooling circuit to said reservoir; and a third valve disposed in said third conduit, said third valve having a first position wherein communication between said cooling circuit and said reservoir is prevented and a second position wherein the communication is permitted.

10. A cooling circuit as claimed in claim 9, wherein said valve and conduit means further comprises said second level sensor.

11. A cooling circuit as claimed in claim 1, further comprising:

a temperature sensor, said temperature sensor being disposed in said coolant jacket in a manner to be immersed in the liquid coolant therein; and a device associated with said radiator, said device being selectively energizable in response to the output of said temperature sensor.

12. A method of operating a cooling system of an internal combustion engine comprising the steps of:

introducing liquid coolant into a coolant jacket disposed about a structure of the engine which is subject to high heat flux;

permitting the liquid coolant to boil and produced vapor;

condensing the vapor into a condensate in a radiator;

returning the condensate formed in said radiator to said coolant jacket in a manner which maintains the structure immersed in a predetermined depth of coolant;

sensing a parameter which varies with the amount of coolant contained in a cooling circuit which includes said coolant jacket and said radiator and producing a signal indicative thereof;

monitoring the signal and determining within a predetermined period from one of (a) the start of the engine and (b) the demand for engine operation;

diagnosing the existence of a system malfuction based on the data derived in the step of monitoring and one of producing a signal indicative thereof and stopping the operation of said engine.

* * * * *